United States Patent [19]

Avery et al.

[11] 4,412,831

[45] Nov. 1, 1983

[54] TWO PLANE SELF-BALANCING CENTRIFUGE

[75] Inventors: Hollon B. Avery, Worcester; Donald W. Schoendorfer, Brookline, both of Mass.

[73] Assignee: Haemonetics Corporation, Braintree, Mass.

[21] Appl. No.: 281,648

[22] Filed: Jul. 9, 1981

[51] Int. Cl.[3] ..... B04B 9/00

[52] U.S. Cl. ..... 494/46; 494/82; 494/83

[58] Field of Search ..... 494/46, 82, 83, 84; 68/23.3, 23 R, 23.1, 23.2, 24; 248/638; 210/364, 363; 366/220, 60, 61, 54, 232, 233, 62, 63

[56] References Cited

U.S. PATENT DOCUMENTS

| | | | |
|---|---|---|---|
| 648,111 | 4/1900 | Nilsson . | |
| 2,746,569 | 5/1956 | Castner | 68/23 |
| 2,793,757 | 5/1957 | McWethy | 68/23 |
| 2,942,494 | 6/1960 | Gooch | 74/573 |
| 3,021,997 | 2/1962 | Czech | 233/23 |
| 3,606,143 | 9/1971 | Stallmann | 233/23 |

*Primary Examiner*—Robert W. Jenkins

*Attorney, Agent, or Firm*—Hamilton, Brook, Smith and Reynolds

[57] ABSTRACT

A two plane self-balancing centrifuge is disclosed herein in which the centrifuge rotor is driven by a shaft attached to bearings. The bearings are supported by upper and lower flexible bearing mounts. This results in two horizontally flexible bearing mounting planes to provide a greater degree of freedom for the axis of rotation of the rotor to move into a coincident relationship with the angular momentum vector of the rotor as it changes with dynamic imbalance thereby to compensate for any imbalance which may occur in the centrifuge rotor during processing. The centrifuge particularly suited for use in processing blood.

15 Claims, 7 Drawing Figures

TWO PLANE SELF-BALANCING CENTRIFUGE

DESCRIPTION

Technical Field

This invention is in the field of blood processing and more particularly relates to a self-balancing centrifuge particularly suited for separating blood into its components.

Background Art

One of the most commonly used techniques for separating blood into its constituent components is a centrifuge. Copending U.S. Pat. Application, Ser. No. 5126 to Allen Latham, Jr. filed Jan. 22, 1979, now U.S. Pat. No. 4,303,193, (hereinafter the Latham centrifuge) describes such a centrifuge. Blood component separating centrifuges operate under the principle that fluid components having different densities or sedimentary rates may be separated in accordance with such densities or sedimentary rates by subjecting the fluid to a centrifugal force field.

The rotors of such centrifuges must be capable of operating speeds in the range of 2000–3000 r.p.m. At such speeds, slight imbalances in the rotor produce intolerable vibrations. These imbalances may be of two types, i.e., static imbalances and dynamic imbalances. Static imbalances may be minimized by careful attention to the location and weight of rotor components and rotor shape to achieve static symmetry about the rotor drive shaft.

However, no matter how well balanced a centrifuge rotor is initially, experience has shown that such balance is not preserved as the centrifuge undergoes repeated usage.

One technique which has been widely employed in efforts to avoid imbalance is the static balancing of centrifuges by adding weight at appropriate locations within the rotor prior to each centrifuge run. This is time consuming, can add inordinately to the expense of separation because of the large amount of operator time involved, and is, at best, only an approximation of adjustments required to overcome dynamic imbalance. Furthermore, static balancing does not obviate dynamic imbalance which occurs in the centrifuge rotor as separation occurs and separated components are transported to various rotor locations, thereby creating an imbalance.

Because of this, it has long been desirable to provide a centrifuge which is self-balancing, that is, one which will automatically and continuously accommodate the degree of imbalance likely to be encountered in any particular application. Many different techniques have been suggested in the art for making centrifuges self-balancing, and generally, all of these can be categorized as either efforts to provide some degree of freedom to the rotor axis of rotation so that the axis of rotation can align itself with the angular momentum vector of the system as the centrifuge rotor is spun or, efforts to provide some degree of freedom to the angular momentum vector so that the angular momentum vector can align itself with the axis of rotation as the centrifuge rotor is spun.

The patent literature contains a variety of mechanisms intended to add such a self-balancing feature to centrifuges. Many of these attempts involve the use of an elongated, relatively flexible drive shaft, often coupled with a flexible bearing mount. One design for a flexible shaft is disclosed in U.S. Pat. No. 2,942,494 wherein a rotor or bearing shaft has a center portion of lesser diameter than its two end portions to provide the rigidity required for driving the rotor as well as the flexibility to compensate for imbalance therein. The use of a flexible rotor shaft together with flexible bearing mounts is also disclosed in U.S. Pat. No. 3,021,997 and in U.S. Pat. No. 3,606,143.

The use of a flexible bearing support for the bearing nearest the rotor and a fixed pivot bearing for the lower drive bearing plane has proven sufficient to handle some degree of imbalance. However, this design operates satisfactorily only when the degree of imbalance is such that the angular momentum vector lies relatively close to the center of rotation of the lower bearing. With the amount of imbalance encountered in many applications, it is necessary to provide an extremely long rotor shaft to achieve this condition. Depending upon the degree of imbalance in some cases, it would not be practical to achieve balance even with a very long rotor shaft. In general, centrifuges having an upper flexible bearing mount with a fixed pivotal lower bearing mount will be referred to herein as *single plane* self-balancing centrifuges.

The Latham centrifuge previously mentioned is an example of a single plane type self-balancing centrifuge. In the Latham centrifuge, separation of whole blood occurs in a flexible blood processing bag located within the centrifuge rotor. As separation occurs, one or more of the separated blood components are transported to a separate location within the centrifuge rotor where they are stored. Since fluid components are being transported from one location to another within the centrifuge rotor, significant imbalance is created. FIG. 7 in the Latham application discloses a single plane self-balancing centrifuge designed to overcome forces caused by imbalance in this system.

While the Latham centrifuge represents a significant advancement over the state-of-the-art at the time the invention was made, it is still incapable of tolerating the degree of imbalance created in some centrifuge applications.

DISCLOSURE OF THE INVENTION

This invention relates to a self-balancing centrifuge which will be referred to herein as a two-plane self-balancing centrifuge. In this centrifuge, both the upper and lower bearing mounts of the bearing shaft are capable of substantial movement in the horizontal plane to enable the bearing shaft to move in two horizontal planes for a greater degree of freedom for the axis of rotation of the rotor to move so that the axis of rotation can align itself with the angular momentum vector of an imbalanced system.

This two plane self-balancing centrifuge has a relatively rigid rotor bearing shaft extending downwardly from the rotor, and means to drive the rotor at a speed sufficient for separation. In the two plane self-balancing system, the bearing shaft is rigidly connected to the rotor and, in the static condition, is coincident about the rotor drive shaft. The bearing shaft is journaled between an upper flexible bearing mount and a lower flexible bearing mount. This allows the bearing shaft sufficient freedom so that it can move horizontally to align the axis of rotation of the rotor with the angular momentum vector of the system as separation and therefore imbalance occurs during operation.

The two plane self-balancing centrifuge described herein has significant advantages over single plane self-balancing centrifuges of the prior art. For example, the distance between the upper and lower bearing planes is not required to be great and can be considerably shorter than the corresponding distance in many single plane self-balancing centrifuges thereby making a more compact, portable centrifuge system possible. Additionally, since the center of gravity of the rotor is close to the upper bearing, "run-out" (lateral motion) due to imbalance is transmitted mostly to the lower bearing. Because of this, the radius of rotation of the upper regions of the rotor, where separation occurs, is more constant than with previously disclosed self-balancing centrifuges.

Probably the most significant advantage, however, is that the centrifuge is more tolerant to gross imbalances occurring in the centrifuge rotor as separation occurs. Because of this, centrifugation techniques can be extended to new blood separation procedures requiring extremely fine cuts between blood components having very similar densities and to procedures requiring extremely thin separation zones.

BEST MODE FOR CARRYING OUT THE INVENTION

The preferred embodiments of this invention can now be further described with specific reference to the Figures.

Figure 1:
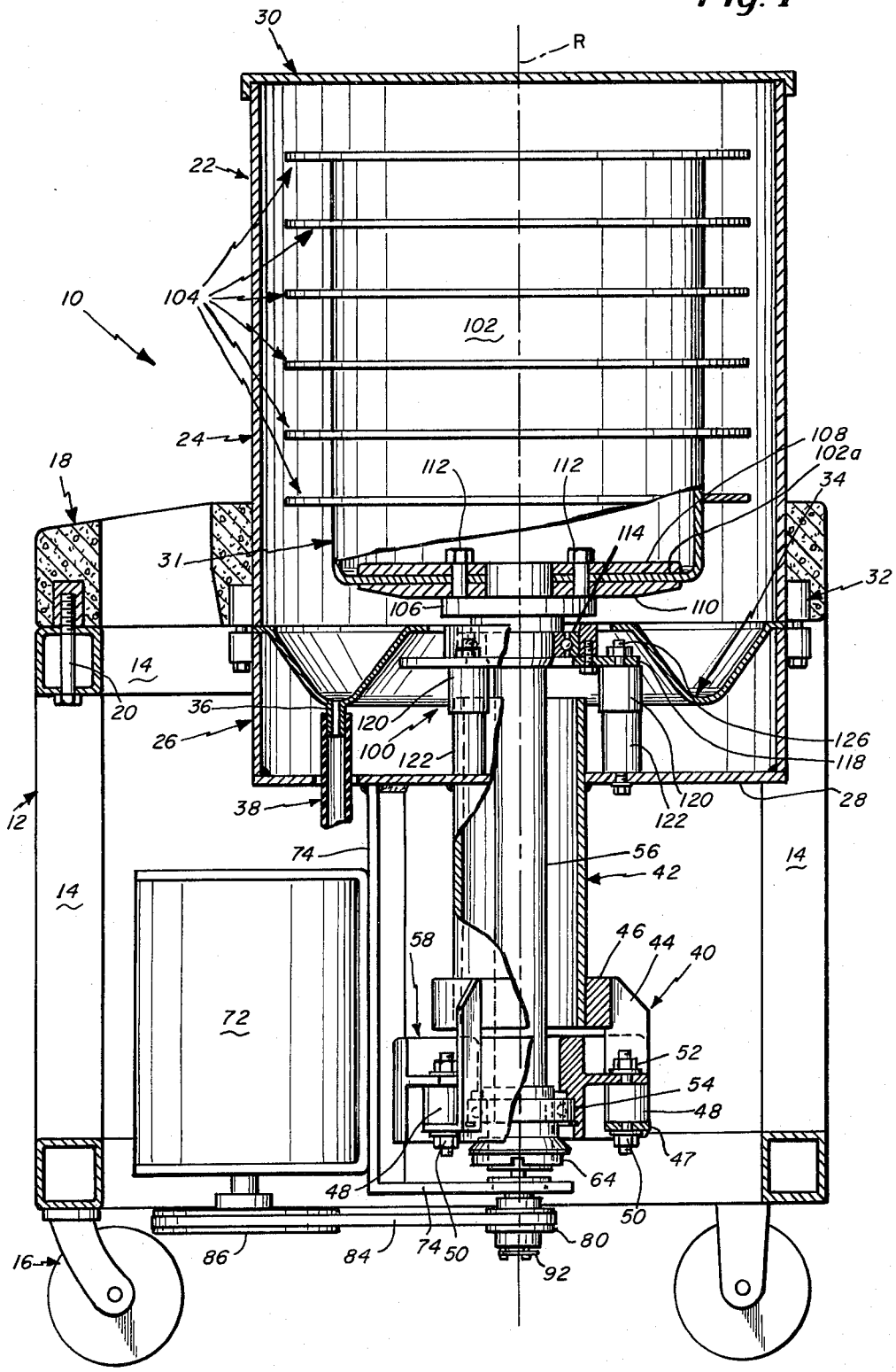
FIG. 1 is a side elevational view, partially cut away, of a two plane self-balancing centrifuge apparatus according to this invention.

One embodiment of a two plane self-balancing centrifuge apparatus 10 is illustrated in FIG. 1, with more specific illustrations of some of the detailed parts presented in FIGS. 2–5. As seen in these Figures, centrifuge apparatus 10 has a movable chassis 12, which can be formed from square structural steel tubing members 14 fastened together to provide a chassis having a rectangular cross-sectional shape. In a typical embodiment, the rectangular opening at the top of chassis 12 might be about 18 inches by 23 inches and the chassis might have a depth of about 16 inches. Chassis 12 is supported on casters 16 to make centrifuge apparatus 10 portable.

A relatively heavy mass 18 is fastened to the top of chassis 12 to provide a relatively fixed structure for anchoring the various centrifuge components and as an initial base to contribute to the mass of the dynamic system. Mass 18 might be formed, for example, from cement or epoxy cast into a shape appropriate for the top of chassis 12 and might weigh, for example, in a typical case, about 180 pounds. For comparison, the balance of the components for centrifuge apparatus 10 might weigh about 70 pounds. Mass 18 is fastened to chassis 12 by means of a pattern of bolts 20 which extend through the tubular members 14 of chassis 12 and into internally threaded holes in cast mass 18.

A completely enclosed rotor shield 22 is provided by upper side wall sections 24, lower side wall sections 26, bottom wall member 28, and removable cover 30. Upper wall sections 24 are embedded directly into mass 18 whereas lower wall sections 26 are bolted by a series of bolts 32 directly to mass 18. A drip chamber 34 is provided underneath rotor container 31. The drip chamber 34 may be formed from plastic in the shape of a circular trough so that liquids collect in the bottom of the trough and exit through port 36 and spilled liquid exit tube 38. Cover 30 is preferably formed from a transparent high strength material, such as transparent polycarbonate, so that the contents of the rotor 102 can be viewed during operation with the aid of a strobe light. Rotor 102 is substantially cylindrical aluminum container 31 adapted to accommodate blood processing apparatus, for example, of the type described in copending U.S. Pat. Application No. 281,655 filed July 9, 1981 to Latham and Schoendorfer. A series of annular metal rings 104 are welded onto the exterior surface of container 31 in spaced apart relationship concentric with the axis of rotation R of the rotor 102. These rings 104 serve as ribs and strengthen the cylindrical wall of the rotor which is subjected to large forces when the centrifuge is in operation.

For the two plane self-balancing centrifuge illustrated in FIGS. 1–5, typical dimensions for the centrifuge rotor 102 might be an inside diameter of about $10\frac{3}{4}$ inches and with a diameter of the rotor shield being about 16 inches.

A bearing shaft 56 is affixed to hub 106 and this assembly is attached to the bottom portion, 102*a*, of rotor 102. Hub 106 is fastened to the bottom portion 102*a* of rotor 102 by means of upper and lower fastening plates 108 and 110, which are held together by means of bolts or machine screws 112. Fastening plates 108 and 110 provide additional material strength at this junction.

An upper and lower plane flexible bearing mount system 100 and 40, respectively, cooperate with shaft 56 (as will now be described in detail) to enable the axis of rotation of the rotor to be displaced so as to align itself with the changing direction of the angular momentum vector of the rotor as it rotates under imbalanced conditions.

Figure 3:
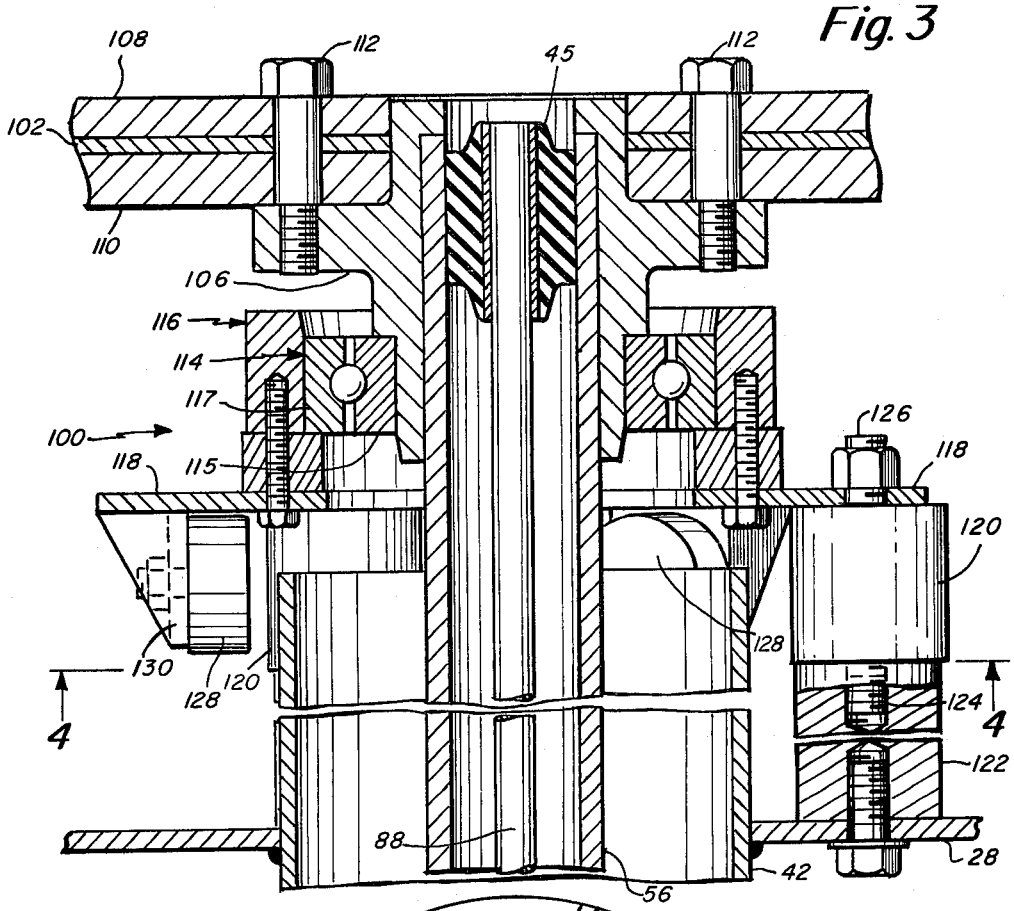
FIG. 3 is a partial cross-sectional view of the upper plane bearing mount subsystem for the centrifuge of FIG. 1.
Figure 5:
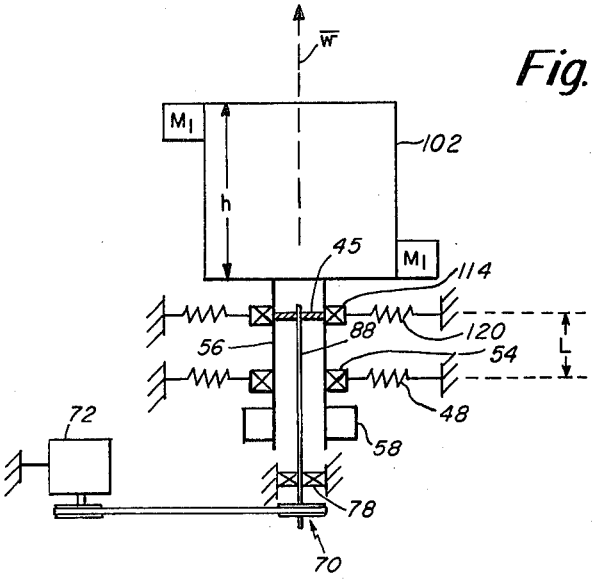
FIGS. 5, 5A and 5B are simplified schematic diagrams illustrating the invention in FIGS. 5 and 5B as compared with the Prior Art in FIG. 5A.

The upper plane bearing mount system is shown in detail in FIGS. 3 and 5, as well as FIG. 1. As shown, the upper plane bearing mount system comprises, in general, a bearing unit 114, the inner race of which, 115, is rigidly attached to bearing shaft 56 the outer race of which 117 is flexibly attached to the chassis via flexible bearing mounts 120.

The inner race 115 of upper bearing unit 114 is rigidly held against hub 106 by a press fit and, as above mentioned, hub 106 is rigidly attached to bearing shaft 56. The outer race 117 of bearing unit 114 has a light press fit to tubular collar 116 which in turn is bolted to horizontal supporting plate 118. The upper plane bearing mounts are attached to and support this plate 118. The upper plane bearing mounts system employs elastomeric mounts 120 which are located on top of optional spacer element 122. Elastomeric mounts 120 comprise solid cylindrical pieces of elastomeric material which are softer in the horizontal plane than in the vertical plane. Threaded studs 124 and 126 are integrally incorporated at each end of elastomeric mount 120. The mounts 120 are secured at the top to supporting plate 118 by bolting studs 126. The mounts 120 are secured at the bottom to bottom wall 28 by stud 124 which may optionally be attached to spacer 124 which in turn is attached to bottom wall 28.

A snubbing system is provided by mounting a series of horizontal snubbers 128 on brackets 130 extending from the bottom of supporting plate 118. Snubbers 128 are elastomeric members which limit the horizontal traverse of rotor 102 by snubbing support tube 42 as the drive shaft 88 wanders horizontally in response to imbalance in the centrifuge rotor 102.

Figure 2:
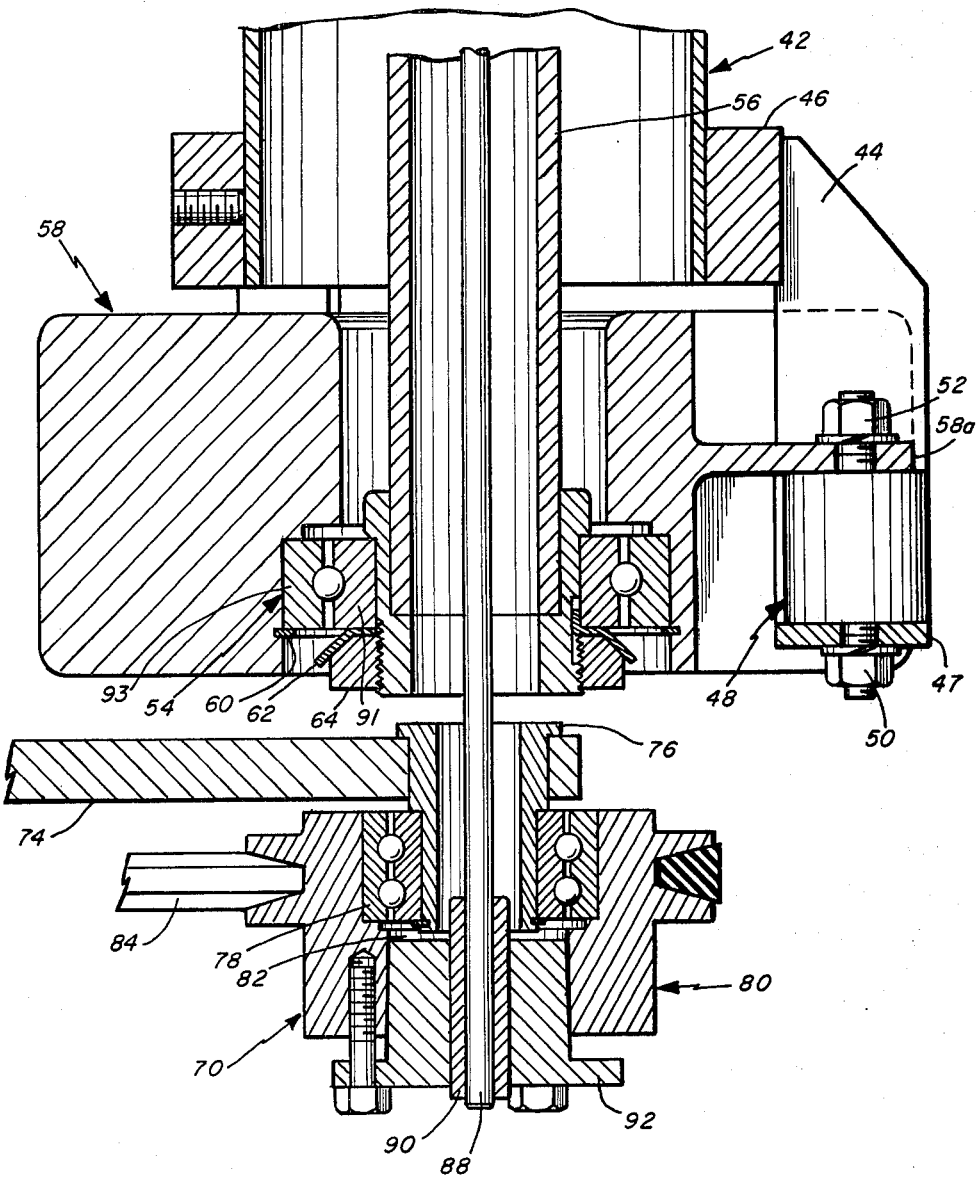
FIG. 2 is a partial cross-sectional view illustrating the lower plane bearing mount subsystem for the centrifuge of FIG. 1.

Lower plane bearing mounts system 40 and the associated rotor drive pulley and bearing is illustrated in the exploded view of FIG. 2. The lower plane bearing mounts system 40 comprises, in general, a bearing unit 54, the inner race of which, 91, is rigidly attached to bearing shaft 56, the outer race of which, 93 is flexibly attached to the chassis via bearing mounts 48 similarly to the previously described upper plane bearing mounts system.

The inner race 91 of bearing unit 54 is rigidly affixed to bearing shaft 56 by means of washer 62 and nut 64 threaded onto one end of shaft 56. The outer race 93 of bearing unit 54 is attached to the inside lower portion of a mass 58 by means of retainer ring 60. The purpose of the mass 58 is to fix the resonant frequency of the mass/-spring system of the lower bearing mounts at a predetermined value.

Mass 58 has three flanged portions 58*a* to which are affixed three mounts 48 of similar construction to the mounts 120 previously described. For example, mounts 48 may comprise a solid cylindrical piece of elastomer which is softer in the horizontal plane than in the vertical plane. A typical example of a suitable mount of this type is the model A34-041 isolation mount sold by Barry Controls, Watertown, Mass. The upper portion of each mount 48 is fastened to mass 58 at flange surface 58*a* by studs 52. The lower portions are fastened to the lower transverse member of brackets 44 by studs 50. Brackets 44 are integrally fastened to supporting ring 46, which is, in turn, integrally fastened to support tube 42. Brackets 44, as may be seen, comprise generally L-shaped rigid metal members with a lower transverse member 47 extending outwardly from the plane of FIGS. 1 and 2.

The rotor drive subassembly 70 can best be seen in FIGS. 1 and 2. Motor 72 is mounted on a rigid L-shaped support 74 integrally attached at its upper end to the bottom 28 of lower side wall section 26. The lower transverse portion of L-shaped support member 74 has a bushing 76 extending therethrough against which the inner race of drive bearing unit 78 is fitted and retained by drive pulley 80 and snap ring 82. Drive pulley 80 is driven by drive belt 84 extending from drive pulley 86 of motor 72. Rotor drive shaft 88 is press fit into bushing 90 which is taper-locked to pulley 80 with a taper lock fitting 92.

Figure 4:
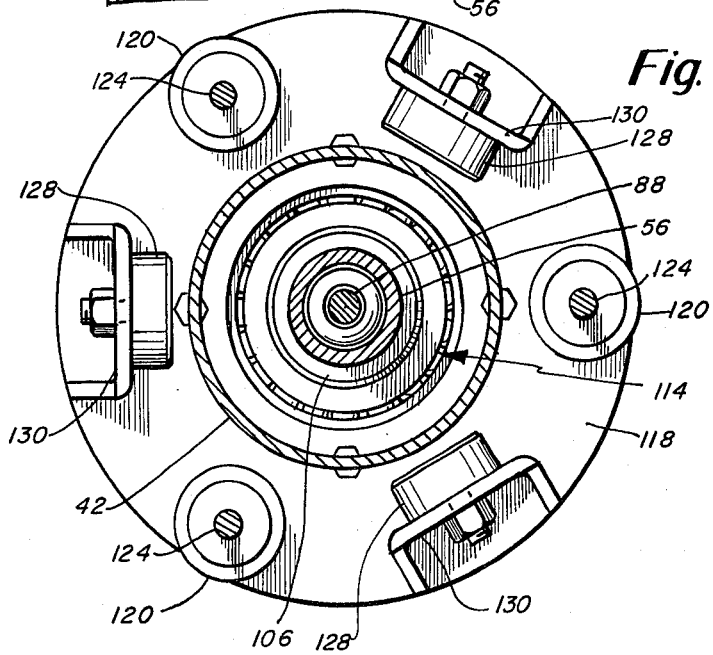
FIG. 4 is a cross-sectional view along section line 4—4 of FIG. 3.

As may be seen in FIG. 4, the upper end of drive shaft 88 is secured to bearing shaft 56 by an elastomeric center bonded joint 45. Joint 45 provides a resilient coupling between the bearing shaft 56 and the drive shaft 88 thereby transmitting torque power from the drive shaft while minimizing transmission of high frequency noise.

At this juncture, and with the risk of oversimplification, it may be helpful to review the mechanism heretofore described in schematic form as shown in the schematic of FIG. 5 wherein items described in FIGS. 1–4 retain corresponding numerals. As may be seen in FIG. 5, the rotor 102 is rigidly coupled to bearing shaft 56 which rotates within bearing races 114 and 54. Mass 58 is suspended at the lower end of bearing shaft 56. The upper and lower berings 114 and 54 are flexibly supported in the horizontal plane by respective mounts 120 and 48.

The bearing shaft 56 is driven by drive shaft 88 which is coupled to bearing shaft 56 through resilient joint 45. Drive shaft 88 in turn is driven by motor 72 via drive assembly 70.

When the rotor is balanced, the angular velocity vector $\overline{\omega}$ shown in dotted lines and the angular momentum vector $\overline{H}$ are coincident. When dynamic imbalance in the rotor 102 occurs, as depicted by locating a mass $M_1$ at the top of one side of the rotor and an equal mass $M_1$ at the opposite lower side of the rotor, the angular momentum vector $\overline{H}$ tends to rotate away from the normal axis of rotation of a balanced rotor (or the angular velocity vector $\overline{\omega}$). It can be shown that, if the vector $\overline{H}$ does not pass through the center of rotation of the lower bearing, vibration will occur at any frequency of rotation.

Figure 5A:
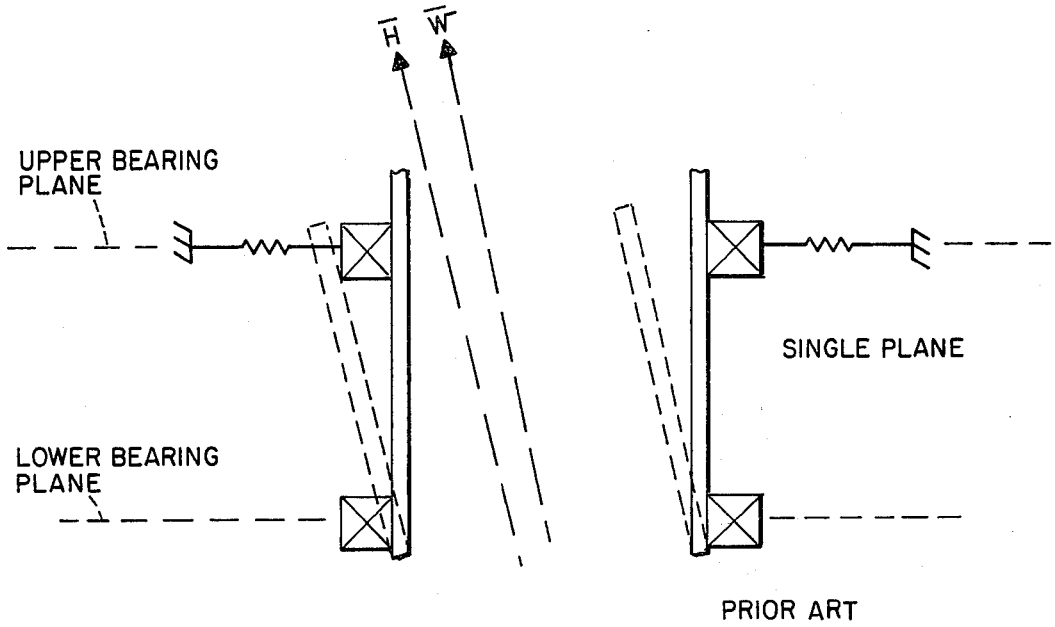
PRIOR ART Fig. 5A

In the prior art, as represented by the single plane Latham centrifuge, depicted in FIG. 5A, the top bearing is flexibly supported in the horizontal plane and the lower bearing is a fixed pivot bearing. In such a device, as long as the rotor rotates at a frequency above the initial resonance of the flexure of the upper bearing plane, the upper bearing will wander so that the rotor will tend to rotate around an axis $\overline{\omega}'$ close to the axis of the vector $\overline{H}'$ but not coincident to it.

Figure 5B:
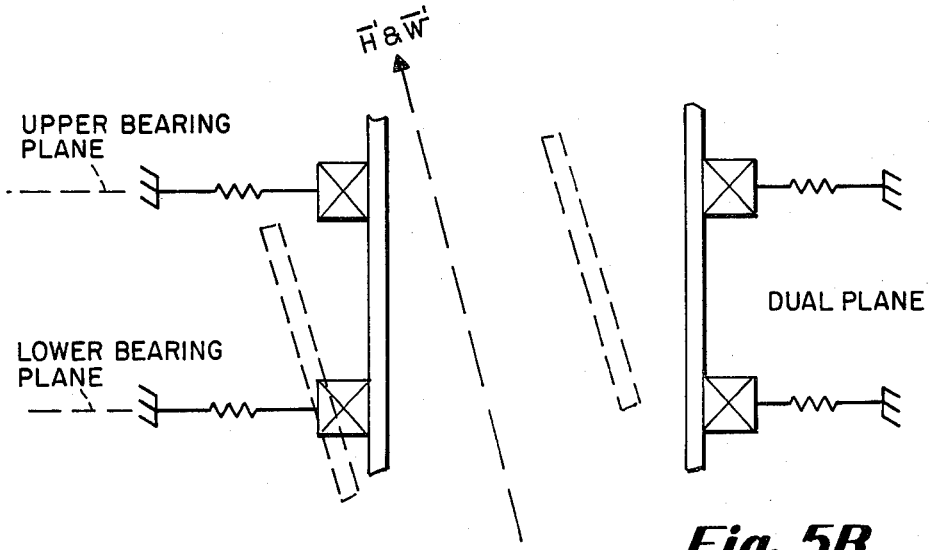

The degree of alignment of the vectors $\overline{H}$ and $\overline{\omega}$ depend on:

- the frequency of rotation
- the resonant frequencies of the upper and lower bearing planes
- the geometry of the rotor
- the type and magnitude of imbalance The single plane Latham centrifuge can be made less sensitive to imbalance by maximizing the distance "L" between the upper and lower bearing planes and minimizing the height "h" of the rotor. In the apparatus of the present invention, we have been able to make the critical resonance frequencies of both the upper and lower bearing supports well below the operating frequency of the rotor. Since the lower bearing support is now laterally flexible in the horizontal plane, the angular velocity vector $\overline{\omega}'$ has more freedom to align itself with the angular momentum vector $\overline{H}'$ as shown by the arrow $\overline{\omega}'$ in FIG. 5B. In addition, the dimensions L and h are no longer critical.

In a specific application of the embodiment heretofore described, it is important to permit the upper and lower bearing support structure sufficient freedom or flexibility in the horizontal plane to allow the axis of rotation (angular momentum vector $\omega$) to align itself with the angular momentum vector $\overline{H}$ but at the same time to minimize transmittal of forces to the chassis 12. Such forces would be manifested as undesired noise or vibration. Appropriate flexible bearing mounts may be selected as follows to assure desired freedom of movement but prevention of excessive movement.

The ratio of maximum transmitted force to maximum applied force is defined as force transmissibility "T". It is highly desirable to limit T to values of 0.1 or less to preclude excessively large motion from the rotor to the cabinet.

The maximum transmissibility occurs when the rotor rotation speed "f" is equal to the undamped natural frequency $f_n$ of the rotor mass-flexible bearing spring system; in other words, when $f/f_n \cong 1$. It can be shown that with a "damping factor" $\cong 0.10$ and a ratio of $f/f_n \cong 5$ the transmissibility T is approximately 0.06. The "damping factor" is the ratio of the actual damping coefficient "C" to the critical damping coefficient "$C_c$". Furthermore, with a rotor speed of 2000 r.p.m., $f = 2000/60 = 33.3$ cycles per second;

$$f_n = \frac{33.3}{5} \cong 6.7 \text{ cycles/sec.}$$

Knowing $f_n$, the static spring stiffness $K_s$ for an isolation mount is determined from the formula:

$$f_n = 3.13\sqrt{\frac{K_s}{W}}$$

wherein W is the weight of the mass on the spring, or in this case, the effective rotor weight. Assuming an effective weight of 70 pounds:

$$K_s = \frac{6.7^2 \times 70}{3.13^2} = 320 \text{ lbs/in.}$$

The dynamic spring stiffness $K_d$ is then determined from the formula $K_d/K_s = 1.5$ for an elastomeric spring with a hardness of 50 durometer. Thus $K_d = 1.5 \times 320 = 480$ lbs/in. Several commercially available vibration isolators with dynamic spring stiffness in this range are readily available.

A further consideration in the application of the invention is that the amount of horizontal displacement or "run-out" of the isolation system should be adequate to accommodate the maximum displacement reasonably forseeable in operation. For a centrifuge rotor of weight $W = 70$ pounds and a blood bag located at radius "r" = 4 inches containing 500 ml of blood of weight $w = 1.16$ pounds, the gross dynamic imbalance produced by spilling or otherwise relocating the contents produces an eccentricity "e":

$$e = \frac{wr}{W} \text{ or } e = \frac{1.16 \times 4}{70} = .066 \text{ inches}$$

Decelerating the rotor under these conditions of gross imbalance through the resonant frequency of the flexible bearing system results in an amplification of the vibration displacement in proportion to the damping factor of the isolation system in accordance with the formula for maximum transmissibility $T_{max}$:

$$T_{max} = \frac{1}{2(C/C_c)}$$

wherein $C/C_c$ = damping ratio

For a damping ratio of 0.1, as previously established, $T_{max} \cong 5$. The gross displacement is simply $T_{max}$ times $e = 5 \times 0.066$ in. or 0.33 inches.

The apparatus of this invention is considered unique in that it enables a horizontal displacement of this magnitude while still maintaining sufficient vertical stiffness to support the rotor structure. Furthermore, if for unforseen reasons the displacement should exceed these limits; snubbers 128 have been provided to prevent damage to the mounts.

One of the features of the invention which enables the drive system to accommodate relatively large horizontal displacement in a relatively compact vertical drive system is the re-entrant structure of the drive shaft-/bearing shaft assembly which, in effect, enables the drive assembly to be fairly flexible in the horizontal plane yet capable of transmitting torque and while at the same time being also relatively rigid vertically.

Industrial Utility

This invention has industrial utility in the processing of blood, particularly in separating blood into one or more of its components. For example, whole blood can be separated within the rotor of the two plane self-balancing centrifuge described herein into a plasma-rich component and a plasma-poor component. Other separations can also be performed.

Equivalents

Those skilled in the art will recognize, or be able to ascertain employing no more than routine experimentation, many equivalents to the specific components, steps and materials described specifically herein, and such equivalents are intended to be encompassed with the scope of the following claims.

What is claimed is:

1. A centrifuge for processing fluids comprising:

(a) a rotor;

(b) a bearing shaft attached to said rotor and adapted to be driven by a drive means;

(c) first and second bearing members each having a first side rigidly affixed to said bearing shaft and located on said shaft in spaced apart relationship to one another;

(d) first and second spring means being more flexible in one plane than in a plane perpendicular thereto coupled at one point to a second side of the respective first and second bearing members and at another point to a relatively rigid mass means.

2. The apparatus of claim 1 in which the axis of rotation of the rotor when statically balanced is in the vertical plane and the axis of the bearing shaft is coincident thereto.

3. The apparatus of claim 2 in which the more flexible plane of each spring means is the horizontal plane to permit the axis of rotation of the rotor to align itself with the angular momentum vector $\overline{H}$ of the rotor during rotation.

4. The apparatus of claim 3 in which the forces transmitted by imbalance in the rotor are minimized by the spring means.

5. The apparatus of claim 4 in which the force transmissibility T is in the order of 0.10 or less; where T = ratio of maximum transmitted force to applied force.

6. The apparatus of claim 3 in which the undamped resonant frequency "$f_n$" of the spring means is substantially lower than the intended normal range of rotational frequency of the rotor.

7. The apparatus of claim 6 in which the normal rotor rotational speed is in the range of 1000–3000 r.p.m. and $f_n$ is in the order of 1/5 of the r.p.m.

8. The apparatus of claim 1 in which the first bearing member is located on the bearing shaft in close proximity to the rotor.

9. The apparatus of claim 1 including a drive shaft intermediate said bearing shaft and said drive means semi-rigidly coupling the drive means to the bearing shaft.

10. The apparatus of claim 9 in which the bearing shaft is concentric to the drive shaft.

11. The apparatus of claim 10 in which the drive shaft is affixed to the bearing shaft at the end of the bearing shaft nearest the rotor.

12. A centrifuge comprising, in combination:

(a) a centrifuge rotor;

(b) a rotor drive shaft extending downwardly from the bottom of said rotor;

(c) means for driving said rotor drive shaft;

(d) a hollow-bearing shaft integrally fixed to the bottom of said centrifuge rotor and coincident with said drive shaft and supported between upper and lower bearings mounted on respective upper and lower isolation mounts; and (e) coupling means for affixing said rotor drive shaft to said bearing shaft near the top of the bearing shaft.

13. The apparatus of claim 12 including:

(f) a support tube coincident with said bearing and drive shafts and attached to the lower isolation mounts.

14. The apparatus of claim 13 including:

isolation mass means affixed to said lower isolation mounts.

15. The apparatus of claim 13 including snubbing means adjacent said support tube for preventing excessive horizontal motion of isolation mounts.

* * * * *